US008210830B2

(12) United States Patent
Miyazaki et al.

(10) Patent No.: US 8,210,830 B2
(45) Date of Patent: Jul. 3, 2012

(54) VALVELESS MICROPUMP

(75) Inventors: Koji Miyazaki, Fukuoka (JP); Seiichi Tanaka, Fukuoka (JP); Hiroyuki Shimooka, Fukuoka (JP); Hiroshi Tsukamoto, Fukuoka (JP)

(73) Assignee: Kyushu Institute of Technology, Fukuoka (JP)

( * ) Notice: Subject to any disclaimer, the term of this patent is extended or adjusted under 35 U.S.C. 154(b) by 1020 days.

(21) Appl. No.: 11/997,126

(22) PCT Filed: Jul. 10, 2006

(86) PCT No.: PCT/JP2006/313691

§ 371 (c)(1),
(2), (4) Date: Jan. 28, 2008

(87) PCT Pub. No.: WO2007/013287

PCT Pub. Date: Feb. 1, 2007

(65) Prior Publication Data

US 2010/0158720 A1 Jun. 24, 2010

(30) Foreign Application Priority Data

Jul. 27, 2005 (JP) ..... 2005-216984

(51) Int. Cl.
*F04B 17/00* (2006.01)

(52) U.S. Cl. ..... 417/413.2

(58) Field of Classification Search ..... 417/412, 417/413.1, 413.2, 413.3, 414; 137/825
See application file for complete search history.

(56) References Cited

U.S. PATENT DOCUMENTS

| | | | | |
|---|---|---|---|---|
| 6,716,002 | B2 * | 4/2004 | Higashino | 417/413.2 |
| 6,752,601 | B2 * | 6/2004 | Takeuchi et al. | 417/322 |
| 2003/0215342 | A1 * | 11/2003 | Higashino et al. | 417/322 |
| 2004/0146409 | A1 * | 7/2004 | Lee et al. | 417/207 |
| 2006/0083639 | A1 * | 4/2006 | Liu et al. | 417/413.2 |

FOREIGN PATENT DOCUMENTS

| | | |
|---|---|---|
| JP | 2644730 | 5/1997 |
| JP | 10-110681 | 4/1998 |
| JP | 11-251233 | 9/1999 |
| JP | 2004-11514 | 1/2004 |
| JP | 2005-98304 | 4/2005 |

* cited by examiner

*Primary Examiner* — Devon C Kramer
*Assistant Examiner* — Dnyanesh Kasture
(74) *Attorney, Agent, or Firm* — Browdy and Neimark, PLLC

(57) ABSTRACT

A channel is formed as an asymmetric diffuser-shaped channel having a narrow channel on a diffuser inlet side and a wide channel on a diffuser outlet side. The narrow channel is communicated with a variable volume chamber which is provided therein with a piezoelectric element. Vibration generated by actuation of the piezoelectric element causes a pressure variation of a fluid in the variable volume chamber to generate a nozzle flow which in turn causes a smooth flow of the fluid from the wide channel to the narrow channel.

7 Claims, 5 Drawing Sheets

VALVELESS MICROPUMP

FIELD OF THE INVENTION

The present invention relates a miniature pump having no-moving-parts valves, or valveless micropump, which is dedicated to force fluids into a flow channel in, for example, medical and chemical applications.

BACKGROUND AND REVIEW OF RELATED TECHNOLOGY

A lot of research is nowadays going on in the pipeline to develop designer drugs or therapeutics based on genes after the completion of the human DNA sequence of entire human genomes. Explorations into drug design and gene therapies have need of gene tests for individual patients. The gene tests take considerable times, for example several days for current technology. To cope with this, it remains a major challenge to develop analyzers very small in construction called $_{\mu}$TAS short for Micro Total Analysis System or Lab-on-a chip. The $_{\mu}$TAS refers to a microscopic system in which laboratory functions including chemical reaction, metering, pumping, and so on are all integrated on a single chip to make it possible to conduct desired analysis procedure with a less time than ever known. With the microscopic analyzing system constructed as stated earlier, all components necessary for the chemical analysis are mounted on a single chip to shrink in construction the whole system itself, saving reaction time to ultimately cut the times desired for testing.

Among the conventional micropumps are the construction using the one-way valve to allow fluid flow only in one direction, the turbo-type construction like the spiral pump having the rotary part such as rotor. There is further other construction having sophisticated geometry. As being easily imaginable from fluid mechanics, any force dominating the behavior of fluids changes with others depending on whether there is on microscale phase or microscale phase. In microscale flow, the surface force including viscous force and frictional force is predominant over the body force including inertia force and so on. This causes any damage to moving parts and turning components combined in the micropump, raising a major issue of having the micropump itself short-lived. Moreover, the micropump with mechanical components of intricate configuration results in increasing the number of the parts desired, which would give rise to the questions of several more chores to produce many parts and members with precision and assemble them together. Meanwhile, the micropumps are known in which the diffuser/nozzle elements different in configuration are used. Most diffuser/nozzle elements, after review of them, have been turned out to be made in any one of steeply divergent and convergent configurations lying midway between a fluid channel and a pumping chamber. With the micropumps relying on the differential resistance in the fluid channel, it has already been found that the channel geometry combining together the diffuser/nozzle elements constructed as stated earlier is worse in efficiency for the reason their mutual effects get cancelled each other out in relation with the variation in flowing direction of the oscillatory fluid.

One of the prior micropumps is disclosed in for example patent document 1 enumerated later in which there is provided at least one pair of blocks raised in a pressure chamber or a fluid channel communicating with the pressure chamber in a geometry lying in a plane parallel with a diaphragm surface. The micropump is comprised of a first substrate of silicon wafer having a diaphragm actuated to make in part vibration, and a second substrate of silicon wafer combined together with the first substrate in very close contact, the second substrate having the pressure chamber in opposition to the diaphragm. The pressure chamber communicates on one side thereof with a nozzle having shrunk increasingly in width as getting closer the pressure chamber and on other side thereof with another nozzle also having shrunk increasingly in width as getting farther from the pressure chamber. The blocks are raised in pairs at locations where the nozzles are most restricted in width in a relation extending in parallel with the center lines of the nozzles. With the constructed as stated earlier, the blocks are made in geometry their projected images on the plane parallel with the diaphragm surface conform to extension lying on inside wall surfaces of the nozzles.

Moreover, the patent document 2 listed later discloses a micropump befitted to transfer a minute quantity of fluid selectively in either of forward and reverse directions even though made simple in construction. The prior micropump is composed of a first channel whose flow resistance varies depending on the differential pressure, a second channel in which the rate of variation in flow resistance in response to the differential pressure changes is less than in the first channel, a pressure chamber interposed between the first and second channels to communicate them each other, and a piezoelectric element actuated to have the pressure chamber deformed to change the internal pressure thereof. Energization of the piezoelectric element causes the variation in the pressure inside the pressure chamber to change a ratio between the flow resistances of the first and second channels. Changes in the flow resistances relative to the differential pressure changes have the fluids squeezing selectively either of forward and reverse directions.

Another micropump is known in, for example the patent document 3 listed later in which an outlet check valve is made on a substrate surface of intermediate substrate of silicon wafer to cover a fluid outlet hole. The prior micropump, more particular, includes a glass substrate made with the fluid outlet hole and recessed partially below a surface to be joined together with other substrate in close contact, the intermediate substrate of silicon wafer having a fluid inlet and outlet holes to allow the fluid running through there, and another substrate of silicon wafer having a mesa-structure and a diaphragm. All the substrates are stacked one on top of the other in very close contact and sealed hermetically. The outlet check valve is placed on one substrate surface of intermediate substrate of silicon wafer to cover the fluid outlet hole, while an actuator is arranged underneath the diaphragm to drive the diaphragm to open and close the check valve.

The fourth patent document 4 listed later disclosed a vane-type micropump having a housing and a rotor enclosed inside the housing. The rotor includes a rotor body mounted off-center, vanes free to move radially of the rotor body and leaf springs to connect the vanes to the rotor body to urge the vanes outwardly, these parts being all combined integrally into a unitary construction.

The patent documents 1 to 4 stated earlier refer to the following material information.

Patent document 1: Japanese Patent Laid-Open No. H10-110681

Patent document 2: Japanese Patent Laid-Open No. 2005-98304

Patent document 3: Japanese Patent Laid-Open No. H11-257233

Patent document 4: Japanese Patent Laid-Open No. 2004-11514

DISCLOSURE OF THE INVENTION

Technical Problems to be Solved

Substantial time and efforts, meanwhile, are spent upgrading the micro-TAS to shorten further the time taken to conduct an increasing number of analyzing tasks in the fields of medical cares and chemical industries. Development of the micro-TAS looks to further advancement of the microfluidic devices. Above all things, it remains a major challenge to the development of the micropump for manipulation of very small volumes of fluids. The micropumps used for the micro-TAS are called upon to have the performance befitting the transfer of microliter and nanoliter volumes of fluids. The micropumps have to be made in construction to keep the fluids, especially the two-phase fluids containing solids including proteins or the like against clogging in the channels that allow the fluids flowing through there. With the micropumps most critical in size, moreover, the miniaturized parts and members are called upon to make them easier in production and assembly. Among the conventional micropumps are developed the valve-type and turbo-type asrecited earlier. Nonetheless, these types of the micropumps, more they get shrunken in size, become more prone to cause deposition of foreign matter including fine particles, impurities, and so on, whose sediments increase frictional resistance that is encountered when the fluids are pumped, thereby having the micropumps short-lived. Moreover, their sophisticated constructions raise the major problem of a high cost needed in working and assembly of their parts and members. The major questions as stated earlier keep the micropumps against coming into practical use.

It still remains the major challenge to the micropump befitted for the micro-TAS as to how the parts and instruments are made to integrate all analyzing functions on a single chip to further shrink the valveless design to cut the time needed for reaction and inspection. The present inventors attempted to develop the micropump befitted for the micro-TAS from aspects of hydromechanics and hydraulic machinery in hope of the approach to the resolution of the questions as stated earlier in regard to the prior micropumps. After detailed investigation of the mechanism of the human respiration and a kind of the artificial respiration called as the high-frequency ventilation which is said to be less in the burden to the human lung, the present inventors found that the smooth transfer of fluids could be achieved with the application of the oscillatory flow to the fluids in the channels very simple in construction. Unlike the traditional artificial respiration, the high-frequency ventilation causes a very small volume of air of not more than one-tenth the respiratory tract capacities to vibrate with several hundred frequencies per minute, and in doing so carries out the respiratory gas exchange in alveoli. With these, the present inventors predicted occurrence of fluid flow when the oscillatory flow was applied to an asymmetric channel. According to the expectation stated earlier, attempts were made to develop a micropump in which the fluid flow is created by the application of oscillatory flow to the fluid in the asymmetric channel modified in a diffuser simple in construction. The channel of diffuser shape is in favor of shrinkage in construction and further has no element including valves, and so on, which would suffer any wear leading the micropump into breakage. Thus, the present inventors were motivated with the conceptions as stated earlier to develop, produce, and assess the working micropump.

The present inventors predicted in the development of the micropump that the major contributor to create a unidirectional flow could be the asymmetry in both time and space between the suction flow and the discharge flow in the channel caused by the oscillatory fluid and further a whirlpool would participate considerably in the induction of the flow. The micropumps until now, nevertheless, were found to be far from practical use in their efficiencies because the reason that the head of fluid was only up to 1.4 mm when the flow rate remained 0 ml/min, while the flow rate was 1.9 ml/min at the time the head of fluid was 0 mm. Low efficiency of the prior micropumps is considered due to the diffuser/nozzle channel having an overall shape resembling a wedge in which the steeply divergent and convergent configurations are combined together to set off the flow drag at the time of oscillation against each other. Moreover, the intricate combination of many hydraulic machine elements in the micropump is thought to interfere with better understanding of quantitative conditions in the transfer of fluids. To cope with this, the present inventors envisaged developing the channel to solve the problem stated earlier for the micropump.

Accordingly, it is a primary object of the present invention to overcome the shortcomings stated earlier and more particular to develop a novel micropump with applications of the technologies in hydromechanics and hydraulic machinery from aspects of the mechanism of the human respiration and the artificial respiration. A major object of the present invention is to provide a valveless micropump that features a flow channel with just a single diffuser shape. The fluid in the flow channel, when experiencing any oscillatory flow, is squeezed from a spread channel into a reduced channel with accompanying fine particles and so on contained therein. The flow channel rectangular in transverse section has the diffuser-shape channel which changes in transverse section with smooth at a diffuser angle ranging from 10° to 90°. A volumetrically variable chamber with an oscillation actuator is installed to communicate with the flow channel in such a manner that the oscillation actuator makes the fluid inside the volumetrically variable chamber vary in pressure. The pressure variation in the volumetrically variable chamber is in turn converted into an oscillatory flow of the fluid in the flow channel to force the fluid to move with smooth through the channel.

SUMMARY OF THE INVENTION

The present invention relates to a valveless micropump characterized in that a flow channel to allow a fluid flowing through there is provided therein with a diffuser-shape channel that is made reduced at an entry side of a diffuser stream while spread at an exit side of the diffuser stream, and a volumetrically variable chamber with an oscillation activator is made in a way communicating with the fluid channel at the reduced area thereof, whereby an oscillatory motion generated by energization of the oscillation activator causes a pressure variation in the fluid within the volumetrically variable chamber, and the pressure variation in the fluid is in turn converted into an oscillatory flow of the fluid, which causes a unidirectional stream of the fluid in the flow channel.

In one aspect of the present invention, a valveless micropump is disclosed in which the oscillation activator is made of a piezoelectric element. In another aspect of the present invention, a valveless micropump is disclosed in which the flow channel is connected at the reduced channel thereof to a flow tube that functions as an exit side of a nozzle stream, while working as an inlet side of a diffuser stream, and further wherein the flow channel is connected at the spread channel thereof to another flow tube that functions as an entry side of the nozzle stream, while working as an exit side of the diffuser stream. In a further another aspect of the present invention, a valveless micropump is disclosed in which the oscillatory flow exerted on the fluid by the energization of the oscillation activator forces the fluid to flow in a nozzle stream less in flow resistance than a diffuser stream, making pumping action to allow the fluid moving out of the spread channel into the reduced channel. Energization of the piezoelectric element is conducted by, for example application of either electric potential or current.

In another aspect of the present invention, a valveless micropump is disclosed in which the piezoelectric element is directly installed on the volumetrically variable chamber. Moreover, the volumetrically variable chamber is preferably placed in a way communicating with the flow channel through a communication path at a specific location closer to the diffuser-shape channel, more particular, at the side of the reduced channel nearer to a boundary between the reduced channel and the spread channel.

In another aspect of the present invention, a valveless micropump is disclosed in which the diffuser-shape channel has a diffuser angle ranging from 10° to 90°. Especially, the diffuser angle of the diffuser-shape channel lies preferably around 50° to ensure that the fluid may be transferred with most efficiency.

ADVANTAGEOUS EFFECTS

With the valveless micropump constructed as stated earlier, the diffuser-shape channel is made asymmetric geometry taking on different flow resistance depending on which direction the fluid is flowing. More especially, even with the same force to squeeze the fluid, the flow rate will get different in the diffuser stream and the nozzle stream opposite the diffuser stream. With the nozzle stream less in flow resistance than the diffuser stream, the fluid begins moving in the direction more readily allowable to flow, or nozzle direction when the oscillatory flow is applied thereto, thereby developing the pumping function to transfer the fluid. As the nozzle direction refers to the direction in which the channel becomes gradually less in transverse section, the pressure variation occurring in the fluid inside the volumetrically variable chamber changes into the oscillatory flow to force the fluid to flow with smooth in the nozzle direction. Upon energization of the oscillation activator such as piezoelectric element, thus, the fluid is forced in the direction of nozzle stream, or from the spread channel to reduced channel. Here, the diffuser stream refers to the flow from the reduced channel into the spread channel, whereas the nozzle stream refers to the flow from the spread channel into the reduced channel.

BRIEF DESCRIPTION OF THE DRAWINGS

In the accompanying drawings, a code of same numbers and letters throughout the views refers to a like part or component recited later.

Figure 1:
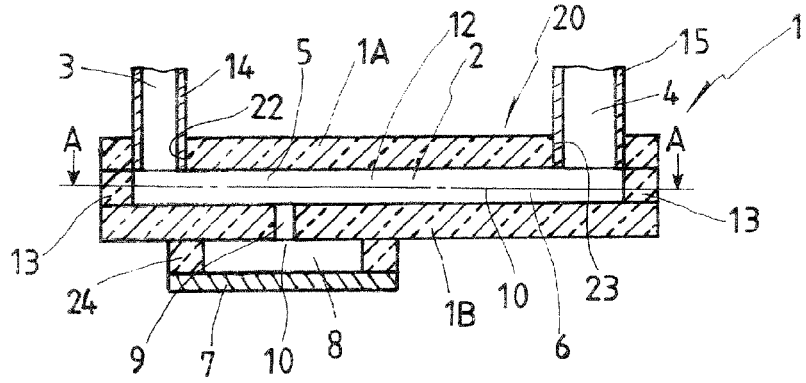
FIG. 1 is a schematic view of a version of a valveless micropump according to the present invention to illustrate basic principals of operation of the valveless micropump.
Figure 2:
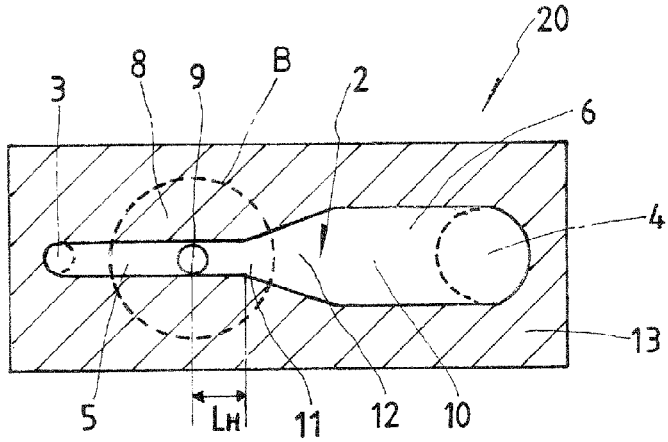
FIG. 2 is a view in section taken along the line A-A to show the valveless micropump of FIG. 1.

2 channel
3 entry side of diffuser stream (=exit side of nozzle stream)
4 exit side of nozzle stream (=entry side of diffuser stream)
5 reduced channel
6 spread channel
7 piezoelectric element
8 chamber variable in volume
9 communication path
10 fluid
12 diffuser-shape channel
13 channel-defining member
14, 15 flow tubes
20 micropump
a diffuser angle

BEST MODE FOR CARRYING OUT THE INVENTION

Figure 3:
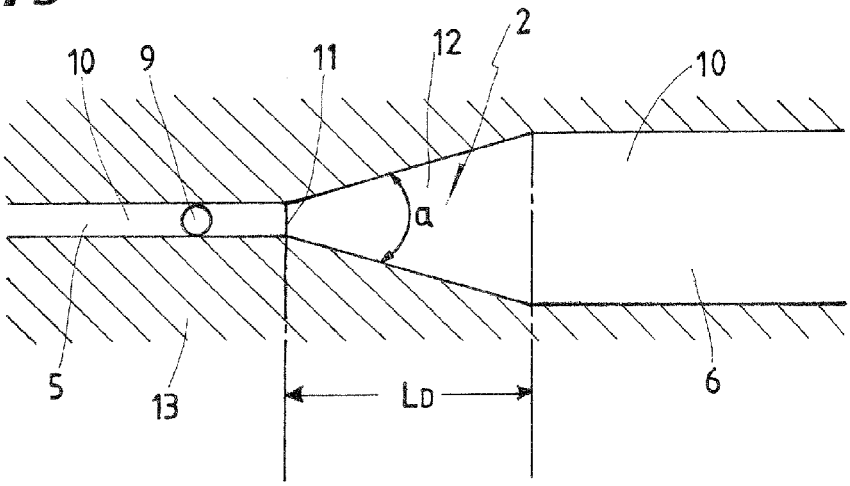
FIG. 3 is an enlarged view showing an area encircled with B of the valveless micropump in FIG. 2.

A preferred embodiment of a micropump constructed according to the present invention will be explained below with reference to the accompanying drawings. The micropump of the present invention features the specific configuration of a channel 2 in which a stream of flow is generated with using a difference in flow resistance across an asymmetric diffuser/nozzle shape. Thus, the micropump of the present invention has no moving part including valves. This constructional feature in turn will help avoid a major issue of any damage of moving parts, and so on inherent in conventional micropumps, thereby having the micropump long-lived. With the micropump of the present invention constructed as shown in FIG. 1, the channel 2 made of a channel-formative member 1 of, for example acryl plate, stainless steel plate, and so on is modified in shape somewhere in the way into an asymmetric diffuser-shape channel 12 made of stainless steel plate. The diffuser-shape channel 12 is flanked in the channel 2 by a throttled or reduced channel 5 made at an entry side 3 of a diffuser stream (corresponding to an exit side of a nozzle stream) and an enlarged or spread channel 6 made at an exit side 4 of the diffuser stream (corresponding to an entry side of the nozzle stream). A cavity variable in volume, or volumetrically variable chamber 8, is installed to open to the reduced channel 5 through a communication path 9 and also provided thereon with an exciting means of a piezoelectric element 7 to create oscillatory motion when energized. The diffuser-shape channel 12 is designed to have a length indicated with LD in FIG. 3. The channel 2 shown in FIG. 1 is composed of two sheets of acryl plates and a single stainless steel plate: a channel member 1A having at one side thereof an inlet opening 22 into which a flow tube 14 fits to make a diffuser entry tube to define the entry side 3 of the diffuser stream and at the other side thereof an outlet opening 23 into which a flow tube 15 fits to make a diffuser exit tube to define the discharged side 4 of the diffuser stream, a channel-defining plate 13 formed in conformity with the diffuser-shape channel 12, and another channel member 1B made therein with the communication path 9. The channel members and channel-defining plate are combined in a way lying on top of one another to complete the diffuser-shape channel 12. Here, as the nozzle stream of flowing rate Q1 is opposite in flowing direction to the diffuser stream of flowing rate Q2, the diffuser entry flow tube 14 functions as an exit at a discharge side of the nozzle stream, while the diffuser exit flow tube 15 at the discharge side of the diffuser serves as an entry tube of the nozzle stream. As an alternative to making the channel 2 with two sheets of acryl plates and a single stainless steel plate as stated earlier, the channel 2 can be made in, for example the two-component construction in which the channel-defining plate 13 is made integral with any one of the channel members 1A and 1B.

With the valveless micropump constructed as stated earlier, energization of the exciting means, more especially, application of an electric potential to the piezoelectric element 7 causes an oscillatory motion which in turn gets the fluid 10 inside the volumetrically variable chamber 8 varying in pressure. This variation in pressure of the fluid 10 is converted through the communication path 9 into an oscillatory flow of the fluid 10 in the channel 2. The oscillatory flow forces the fluid 10 in the channel 2 to move in unidirectional direction. The exciting means of the piezoelectric element 7 in the valveless micropump of the present invention, when subjected to the electric potential, emits a high-frequency oscillation which causes the oscillatory motion to the fluid 10. As a result, the fluid 10 begins to flow into a nozzle stream less in flow resistance than a diffuser stream. Thus, the micropump works on pumping action to squeeze or displace the fluid 10 from the spread channel 6 into the reduced channel 5. With the valveless micropump of the present invention, the volumetrically variable chamber 8 is connected with the channel 2 through the communication path 9, which is made open to the channel 2 at a specific streamwise location that is a distance (LH) of from 0 to 10 mm away from the most reduced or throttled end 11 in cross-sectional area of a diffuser/nozzle-shape channel 12 having a preselected diffuser angle (a). The piezoelectric element 7 attached directly to the volumetrically variable chamber 8, when energized with the electric potential of square wave having a preselected frequency, causes the fluid inside the volumetrically variable chamber 8 to oscillate. The oscillatory motion creates a variation in pressure in the fluid 10, which is converted into the oscillatory flow in the channel 2 to generate a smooth flow of the fluid 10 traveling through the channel 2.

The valveless micropump having the channel geometry of only the diffuser/nozzle shape as stated earlier is very simple in construction to allow largely reduction of the number of parts as compared with the conventional ones and further make production as well as assemblage of parts much easier than existed so far. Moreover, the valveless micropump of the present invention is beneficial to keeping the microscopic analyzing devices with micropump against their reduction in performances because the valveless construction thereof is free from suffering the clogging of the sample including particles and so no, which would otherwise deposit as foreign matter including any scale on the valves. The valveless micropump of the present invention in which the channel is only made in part into the simple geometry of the diffuser/nozzle shape is largely different in construction from most prior micropumps with the diffuser/nozzle shape in which the steeply divergent shape or steep convergent shape is made at the boundary between the channel and the associated diffuser/nozzle shape while the volumetrically variable chamber is placed at the middle of the diffuser/nozzle shape. With the micropump of the present invention, the sophisticated construction in the prior constructions is done away with and further the volumetrically variable chamber 8 is placed out of the diffuser/nozzle-shape channel 12 simple in construction to allow the pressure variations caused in the chamber 8 transferring the fluid with high efficiency.

Figure 4:
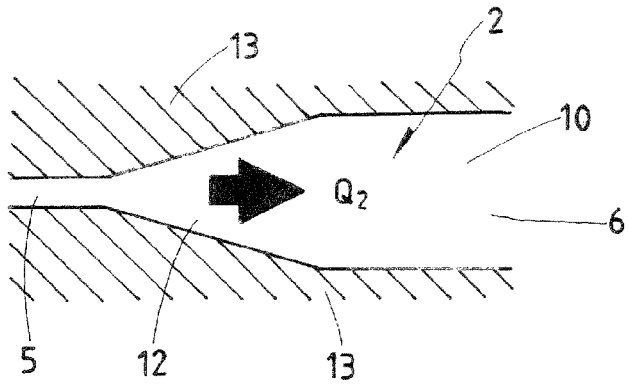
FIG. 4 is an illustration explanatory of a diffuser stream in the micropump.
Figure 5:
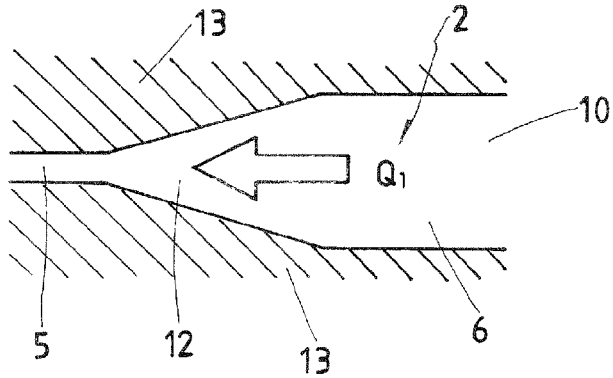
FIG. 5 is an illustration explanatory of a nozzle stream in the micropump.
Figure 6:
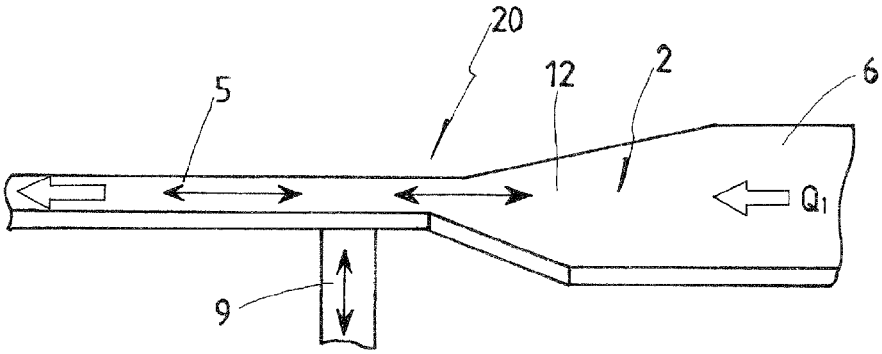
FIG. 6 is a schematic illustration to explain the operation of the valveless micropump.

Referring to FIG. 6, there is shown the principals of operation of the valveless micropump with diffuser/nozzle geometry. With the valveless micropump illustrated there, the channel 2 has partly a zone where the channel 2 varies in increments in cross-sectional area along the stream direction, while the fluid flow applied from the volumetrically variable chamber 8 is introduced into the channel 2 at a location out of the diffuser-shape channel 12. Here, the diffuser stream refers to the channel geometry spreading fluently in transverse section as proceeding in the flowing direction as shown in FIG. 4, whereas the nozzle stream is reversed in relation with the flowing direction as shown in FIG. 5. Difference between the diffuser stream and the nozzle stream, besides the direction a fluid would travel, is in the flow drag, which will vary depending on in which direction the fluid is traveling even though the diffuser-shape channels 12 themselves are equal in their configurations. Usually, the flow drag in the diffuser stream is lager than in the nozzle shape stream.

In FIGS. 4 and 5 illustrating the diffuser-shape channel 12 having a preselected diffuser angle (a), a flow rate Q1 refers to the nozzle stream (FIG. 5) whereas a flow rate Q2 is of the diffuser stream (FIG. 6). In either case, the flow energy applied to the fluid 10 is equivalent to one another. With the conditions as described above, when considering application of a oscillatory flow consisting of a nozzle stream over a time of from 0 to T/2 and a diffuser stream over a time of from T/2 to (T), the quantity (Q) of fluid flowing during a frequency of time range (T) is given by:

$$Q = -\int_0^{\frac{T}{2}} Q_{Diffuser}\, dt + \int_{\frac{T}{2}}^{T} Q_{Nozzle}\, dt. \qquad \text{[formula 1]}$$

As fluid flow in the nozzle stream encounters less flow drag than in the diffuser stream, the fluid can be predicted traveling in the nozzle direction. The flow from the left end as shown in FIG. 6 is delivered in to the volumetrically variable chamber underneath flow channel.

The valveless micropump of the present invention will be explained hereinafter with reference to FIGS. 1 to 6. First looking to FIG. 1, with the valveless micropump of the present invention, the flow channel 2 is made therein with the asymmetric diffuser-shape channel 12 that intervenes between the reduced channel 5 at the outlet side 3 of the diffuser stream (corresponding to the inlet of the nozzle stream) and the spread channel 6 at the inlet side 4 of the diffuser stream (corresponding to the outlet of the nozzle stream). The volumetrically variable chamber 8 is made open to the reduced channel 5 through the communication path 9 and further bonded with the piezoelectric element 7 to generate the oscillations. Application of the electric potential to the piezoelectric element 7 causes the oscillatory motion, which in turn has the fluid 10 inside the volumetrically variable chamber 8 varying in pressure. The changes in pressure occurring in the fluid 10 are converted into the oscillatory flow in the fluid 10 to derive the smooth flow of the fluid 10 in the channel 2.

Then referring to FIG. 7 in addition to FIGS. 1 to 6, the tests on the valveless micropump of the present invention will be explained later in detail. First of all, preliminary tests were conducted to verify whether the valveless micropump constructed according to the conception as stated earlier took on the function of the pump successfully. The channel-defining member 13 was made of a stainless steel plate of 1 mm in thickness, which was machined by a wire electro-discharge processor to follow the channel's contour. The channel 2 was finished by laying the channel members 1A and 1B of alkyl plates on both the top and bottom surfaces of the channel-defining member 13, one to each surface. The channel member 1A on the top side of the channel-defining member 13 was made therein with the outlet opening 22 for the diffuser stream (=the inlet opening for the nozzle stream) and the inlet opening 23 for the diffuser stream (=the outlet opening for the nozzle stream), while another channel member 1B on the bottom side of the channel-defining member 13 was provided with the communication path 9. The glass-made diffuser entry tube 14 (=nozzle exit tube) was connected with the outlet opening 22, while the glass-made diffuser exit tube 15 (=nozzle entry tube) fitted into the inlet opening 23. On the channel member 1B of alkyl plate, there was provided a cylindrical member 24 on which the piezoelectric element 7 is bonded to form the volumetrically variable portion of the chamber 8 variable in volume, which was defined by the combination of the channel member 1B, cylindrical member 24 and the piezoelectric element 7. The acryl plates and stainless steel plate stacked one on the top of the other as stated earlier were clamped into a laminate by the use of bolts or screws with nuts.

Upon actuation of the valveless micropump of the present invention, a square wave having a preselected frequency from a function generator was amplified by an amplifier circuit. The resulting signals were applied to the piezoelectric element 7. The valveless micropump constructed as stated earlier was just as illustrated especially in FIGS. 1 and 2. The valveless micropump prepared for the tests explained herein was further given the following experimental conditions: the frequency of 35 Hz, diffuser angle a of 50°, and the fluid of water. For measurements of the flow rate (Q) running through the channel 2, the micropump 20 was kept in a perpendicular fashion and a graduated cylinder was used to collect and record a quantity of water given off for a preselected period of time. In contrast, the measurements of the head (H) were yielded by measuring a difference in head between an influx opening of the diffuser entry tube 14 and an efflux opening of the diffuser exit tube 15 while the micropump 20 was laid in horizontal fashion. As a consequence, the head H was 43 mm when the flow rate (Q) was 0 ml/min, whereas the flow rate was 1.7 ml/min when the head (H) was 0 mm. The measured effects were considered verifying the diffuser-shape channel 12 having only the diffuser shape in the channel was befitted for the micropump 20.

Figure 7:
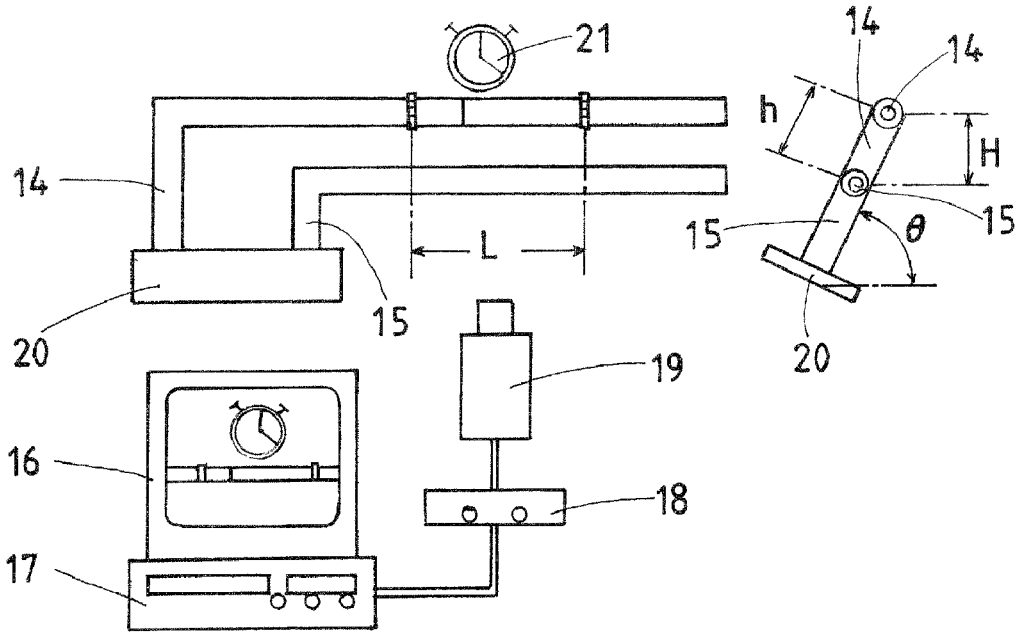
FIG. 7 is a schematic illustration showing an example of a performance testing instrument with the valveless micropump incorporated therein.

Performance tests of the valveless micropump were carried out with a test fixture constructed as shown in FIG. 7 and the test results were as follows.

The valveless micropump 20 set on the test fixture was the same in construction as used in the preliminary tests stated earlier. Both the diffuser entry and exit tubes 14 and 15 were connected to the micropump 20. A stopwatch 21 was used for the performance test of the micropump 20 while a camera 19 with charge-coupled device (CCD) was installed to monitor the diffuser entry tube 14 across a preselected interval (L). Information observed with the CCD-camera 19 was amplified at an amplifier 18 whose output was applied to a video cassette recorder (VCR) 16 and further displayed on a monitoring screen 16. Various values yielded from the performance test fixture were determined in ways as stated later. The head (H) of water referred to a vertical interval (H) in height between the glass-made flow tubes 14 and 15 lying spaced away from each other by a distance (h). The head (H) or the perpendicular interval in height relative to the distance (h) between the glass-made flow tubes 14 and 15 was calibrated while the performance test fixture had slanted at different tilt angles θ. Considering the relation between the tilt angle θ of the performance test fixture and the distance (h) between the flow tubes 14 and 15, the head (H) was given by:

$$H=h\cdot\sin\theta$$

In preparation for the acknowledge of the flow rate (Q), the behavior patterns of liquid interfaces flowing through across an interval (L) of 100 mm marked on the efflux-side glass tube were observed with the stopwatch 21 as well as the CCD-camera 19. Based on the measured amount of time (t) elapsed during the fluid flowed across the interval (L) of the glass tube having the transverse-sectional area (A), the flow rate (Q) was determined as follows:

$$Q=L\cdot A/t$$

The frequency (f) was selected by the function generator.

Figure 8:
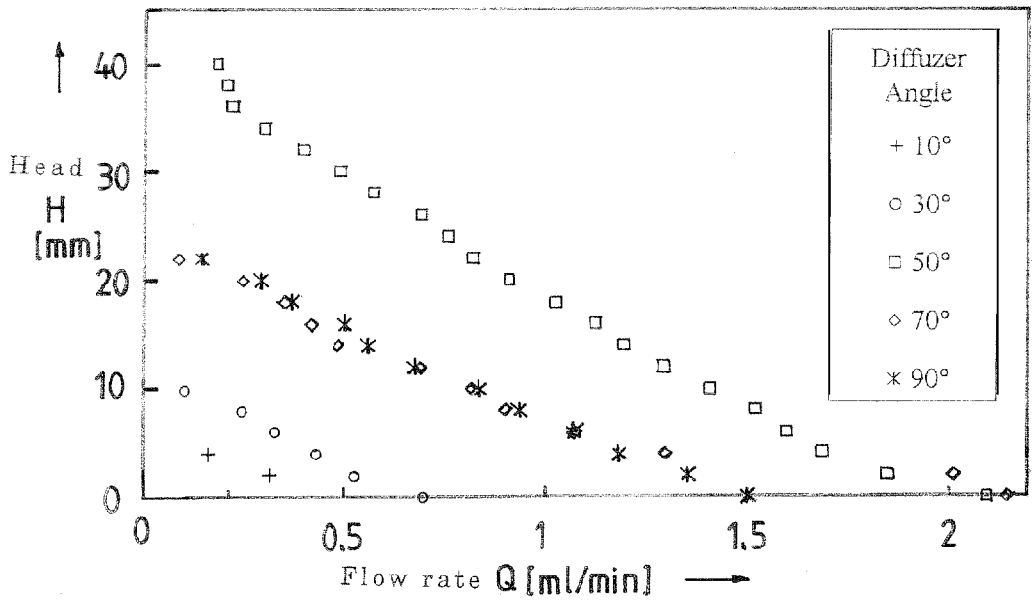
FIG. 8 is a graphic representation of pumping performance curves showing relations between the flow rate and the head of fluid depending on different diffuser angles in the valveless micropump.

Next, referring to FIG. 8, there is shown a graphic representation of performance curves for the relations of flow rate versus head in the valveless micropump of the present invention.

Figure 9:
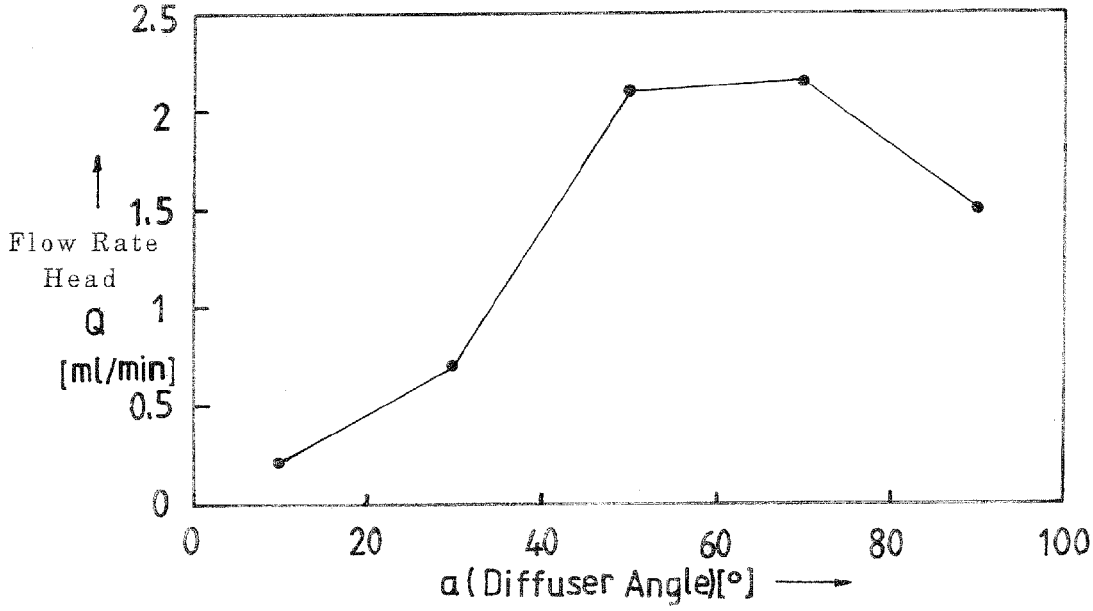
FIG. 9 is a graphic representation showing relations between the different diffuser angles and the maximum flow rate at every diffuser angle in the valveless micropump.

The relations between the flow rate (Q) and the head (H) were measured at different tilt angles θ of the paired diffuser entry and exit tubes 14 and 15 with respect to the horizontal. Other conditions were the frequency of 60 Hz, excitation voltage of 250V and the fluid of water. The diffuser angle a was selected at 10°, 30°, 50°, 70° and 90°. The head (H) was raised in increments of from 0 mm to 2 mm by changes of the tilt angle θ and the flow rate (Q) at the time was measured. The measured results plotted in FIG. 8 revealed that there were almost linear correlations between the flow rates (Q) and the heads (H), or it was found that the desired stream occurred when the diffuser angle (a) was within the angular range of from 10° to 90°. Especially, it was verified that the flow rate (Q) was transferred with most efficiency when the diffuser-shape channel 12 was designed to have the diffuser angle (a) of 50°, which was plotted by the sign of □. Moreover, it was found the greater the tilt angle θ, the less the flow rate (Q). With the valveless micropump in which the diffuser angle a was in or near 50°, it was demonstrated as a consequence that the flow rate (Q) became larger as the head (H) was less. Referring next to FIG. 9, there is shown the relation of the maximum flow rate (Q) with the diffuser angle θ. It was confirmed that the flow rate (Q) came to reach the maximum amount as high as equal to or greater than 2 ml/min with the diffuser angle a ranging from 50° to 70°. After considering the performance curves of flow rate versus head in FIG. 8 along with the curve plotting the relation of the diffuser angle with the peak flow rate, it was identified that the flow rate was transferred with most efficiency when the diffuser-shape channel 12 was designed to have the diffuser angle (a) of 50°.

Figure 10:
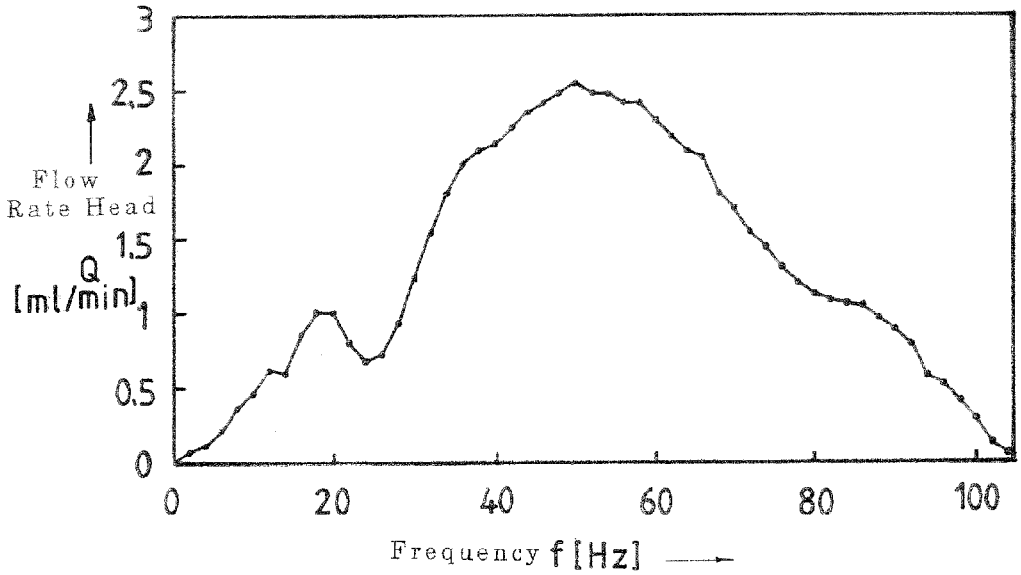
FIG. 10 is a graphic representation showing relations between the flow rate and a driving frequency in the valveless micropump.

Referring further to FIG. 10, there is shown a flow rate-to-frequency performance obtained in the valveless micropump of the present invention.

How the flow rate (Q) changed with different frequencies was measured in order to study the frequency performance of the micropump 20, with the following experimental conditions: the frequency of 35 Hz, diffuser angle (a) of 50°, the electric potential of 250V, the head (H) of 0 mm and the fluid was water. The head of 0 mm referred to the head in height where there was no difference, or 0 mm, between the static head and the rise of interface due to capillarity. A function generator provided frequencies incremented by 2 Hz to measure the flow rate (Q), which was shown in FIG. 10. The resulting flow rate (Q) as seen in FIG. 10 ranged to have the top peak anywhere form 40 Hz to 60 Hz. The secondary peak was observed around 20 Hz or so. With the micropump of the present invention, it was known that the frequency had to be preferably set within the range of from 40 Hz to 60 Hz.

Figure 11:
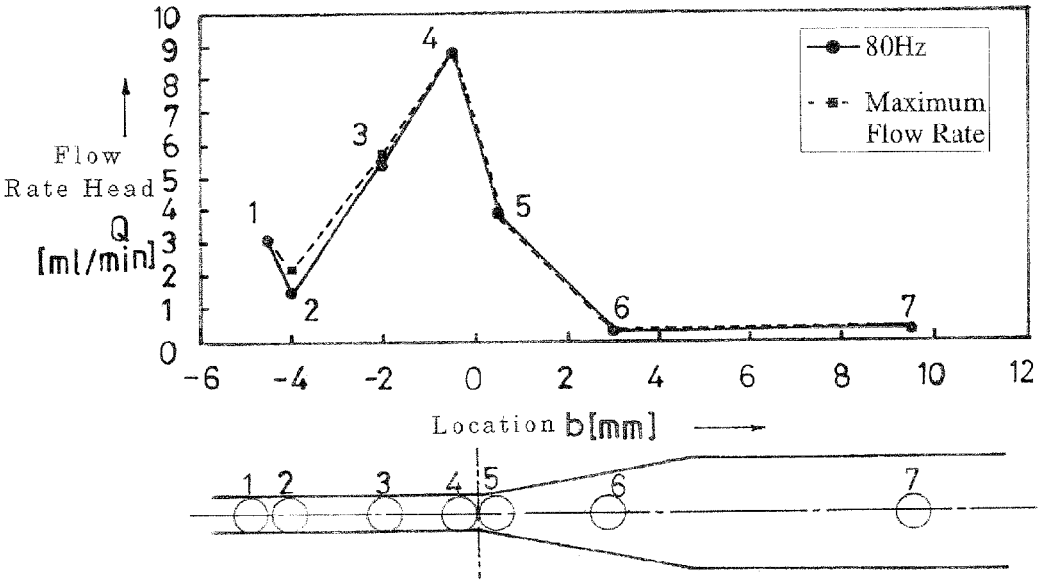
FIG. 11 is a graphic representation showing relations between the flow rate and streamwise locations where a volumetrically variable chamber is associated with a channel in the valveless micropump.

In FIG. 11, moreover, there is shown the relation of the flow rate (Q) with the location of the communication path 9 to connect together the volumetrically variable chamber 8 and the channel 10.

It emerged from FIG. 11 that the communication path 10 extending out of the volumetrically variable chamber 8 was preferably made open to the channel 2 at the location as closer as possible to the diffuser-shape channel 12. That is, the flow rate (Q) marked the peak of 9 ml/min in the construction that the communication path 9 was made open to the channel 12 at the location adjacent to the most reduced or throttled end 11 of the diffuser-shape channel 12. As opposed to the above, the flow rate (Q) was at the bottom in case the communication path 9 to connect the channel 12 with the volumetrically variable chamber 8 was made at other locations far away apart from the most reduced end 11 of the diffuser-shape channel 12, for example about halfway in the diffuser-shape channel 12 or within the spread channel 6. To ensure the best effect of the communication path 9, thus, it was proved important to make the communication path 9 at a specific location in the reduced channel 5 in the proximity to the boundary between the reduced channel 5 and the spread channel 6. Moreover, it was proved that the volumetrically variable chamber 8 was preferably communicated with the reduced channel 5 in closer adjacency with the diffuser-shape channel 12.

Analyses stated in detail earlier on the performance test results of the valveless micropump with diffuser shape simple in construction demonstrated that the valveless micropump 20 produced according to the present invention was improved to have more superior performance characteristics than in the prior diffuser-type valveless micropump, even with simple in construction. Moreover, it will be understood that the performance tests conducted on the valveless micropump 20 revealed sufficiently the performance characteristics of the micropump of the present invention.

INDUSTRIAL APPLICABILITY

The valveless micropump of the present invention, because of smaller in construction and also making it possible to manipulate a very small amount of fluid, is much suitable for fluid-handling industries including micro-TAS, medical equipment such as an artificial pancreas, mechanical ventilator or the like, further bioscience industries, chemical laboratories, measurement/inspection instruments, and so on. Thus, the valveless micropump constructed according to the present invention will be widely available in medical applications and biological fields, and further befit for cooling pumps for CPU and so on, and fuel pumps for miniature fuel cells.

The invention claimed is:

1. A valveless micropump comprising a flow channel, which further comprises a first-diffuser shaped channel;

wherein said first diffuser-shaped channel has a first cross section on an entry side of a diffuser stream and a second cross section on an exit side of the diffuser stream, wherein said first cross section is smaller than said second cross section;

wherein the first diffuser-shaped channel has a diffuser angle ranging from 10 degrees to 90 degrees;

wherein said flow channel additionally has a second channel that is connected to the first cross section on the entry side of the diffuser stream of the first diffuser shaped channel;

wherein said valveless micropump further comprises a volumetrically variable chamber with an oscillation activator which communicates with the flow channel through a communication path that is normal to the flow channel, wherein energization of the oscillation activator generates a net stream of fluid in the flow channel;

wherein a cross section of the second channel at a connection with the communication path is the same as its cross section at a connection with the first cross section on the entry side of the diffuser stream of the first diffuser shaped channel.

2. A valveless micropump defined by claim 1, wherein the oscillation activator is a piezoelectric element.

3. A valveless micropump defined by claim 1, wherein the first cross section on the entry side of the diffuser stream of the first diffuser shaped channel also functions as an exit side of a nozzle stream, and further wherein the second cross section on the exit side of the diffuser stream also functions as an entry side of the nozzle stream.

4. A valveless micropump defined by claim 3, wherein an oscillatory flow resulting from the energization of the oscillation activator causes a lower flow resistance to the nozzle stream than a flow resistance to the diffuser stream, thereby generating said net stream from the second cross section to said first cross section of said first diffuser-shaped channel.

5. A valveless micropump defined by claim 2, wherein the piezoelectric element is directly installed on the volumetrically variable chamber.

6. A valveless micropump defined by claim 1, wherein the diffuser angle of the diffuser-shaped channel is 50 degrees.

7. A valveless micropump comprising a flow channel, which further comprises a first-diffuser shaped channel;

wherein said first diffuser-shaped channel has a first cross section on an entry side of a diffuser stream and a second cross section on an exit side of the diffuser stream, wherein said first cross section is smaller than said second cross section;

wherein the first diffuser-shaped channel has a diffuser angle ranging from 10 degrees to 90 degrees;

wherein said flow channel additionally has a second channel that is connected to the first cross section on the entry side of the diffuser stream of the first diffuser shaped channel;

wherein said valveless micropump further comprises a volumetrically variable chamber with an oscillation activator which communicates with the flow channel through a communication path that is normal to the flow channel, wherein energization of the oscillation activator generates a net stream of fluid in the flow channel;

whereby energization of the oscillation activator causes a pressure variation in the fluid within the volumetrically variable chamber, and the pressure variation results in an oscillatory flow of fluid;

wherein a cross section of the second channel at a connection with the communication path is the same as its cross section at a connection with the first cross section on the entry side of the diffuser stream of the first diffuser shaped channel.

* * * * *